United States Patent [19]

Tsuiki

[11] 4,350,239

[45] Sep. 21, 1982

[54] COIN ASSORTING DEVICE FOR A VENDING MACHINE

[75] Inventor: Tadanobu Tsuiki, Fujimishi, Japan

[73] Assignee: Cosmos Company Limited, Saitama, Japan

[21] Appl. No.: 149,534

[22] Filed: May 13, 1980

[30] Foreign Application Priority Data

May 15, 1979 [JP] Japan ..... 54-59310

[51] Int. Cl.[3] ..... G07F 5/04

[52] U.S. Cl. ..... 194/1 G; 194/63

[58] Field of Search ..... 194/61, 63, 1 G, DIG. 2

[56] References Cited

U.S. PATENT DOCUMENTS 1,874,497 8/1932 Gildemeister ..... 194/DIG. 2
3,010,557 11/1961 Weitzman ..... 194/63
3,376,966 4/1968 Pennell ..... 194/63
4,034,840 7/1977 Reitman ..... 194/1 G X

*Primary Examiner*—F. J. Bartuska
*Attorney, Agent, or Firm*—Browdy & Neimark

[57] ABSTRACT

A coin assorting device for a vending machine which mainly applies to children, whereby goods put in a plastic capsule can be obtained by throwing predetermined coins into a coin slot and then turning a handle by hand, is disclosed. The device is characterized in that a coin assorting member having a recess for receiving one coin on the coin contacting surface thereof is provided. A coin which is not required for checking may pass through the recess. If a coin, which is required for checking, is unsuitable and cannot fully push up the assorting member, a ratchet is caught by the edge of the member to stop a turn thereof, thereby preventing the goods from being obtained.

8 Claims, 5 Drawing Figures

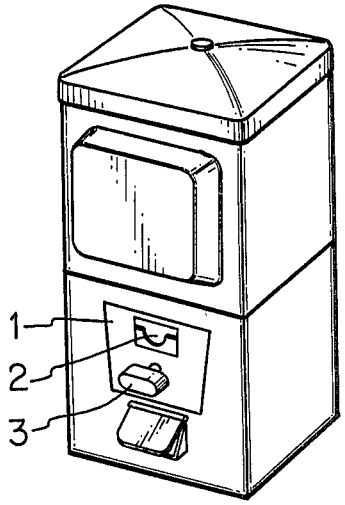
FIG. 1
FIG. 2
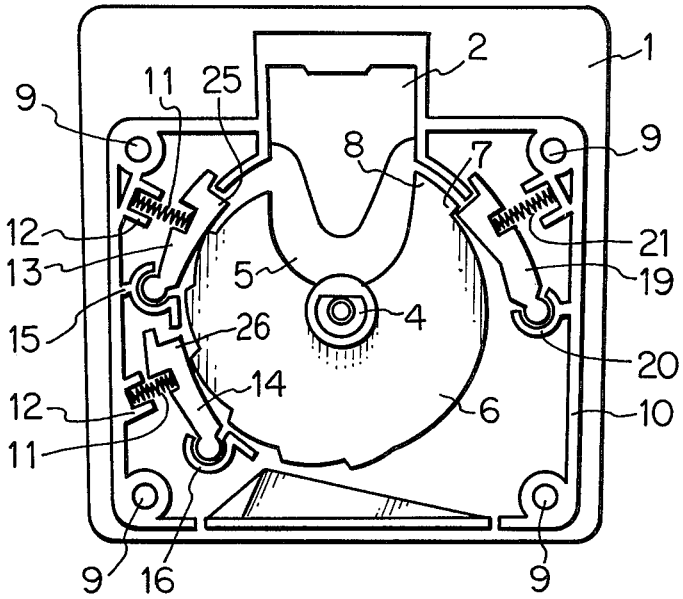
FIG. 3
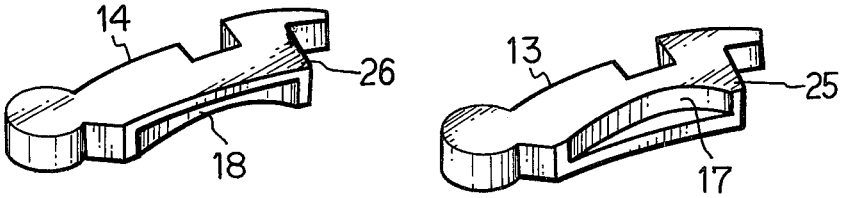

COIN ASSORTING DEVICE FOR A VENDING MACHINE

BACKGROUND OF THE INVENTION

This invention relates to a coin assorting device for a manually operated vending machine, for which a plurality of coins of the same kind may be used.

There are different kinds of vending machines which are mainly to be used by children, whereby goods placed into a plastic capsule can be vended when they insert predetermined coins into a coin slot and then rotate a handle by hand. A coin assorting mechanism for assorting true or false coins or the suitability of any given coin, which is used in vending machines mentioned above and is provided in a vending machine using only one coin, is relatively simple in construction. However, machines using two or three coins require a complicated construction. Since, in these kinds of vending machines, simple and moderately-priced machines are required, particularly, it is desirable that the coin assorting mechanism therein have a simple construction and be highly reliable in operation.

SUMMARY OF THE INVENTION

Accordingly, an object of the present invention is to provide a coin assorting device for a manually operated vending machine which is a simple mechanism and yet effectively distinguishes the suitability of any coin.

Other and further objects, features and advantages of the present invention appear more fully from the following description.

BRIEF DESCRIPTION OF THE DRAWINGS

FIG. 1 shows a perspective view of a vending machine in which a device of the present invention may be assembled;

FIG. 2 shows a structural diagram of the preferred embodiment of the present invention;

FIG. 3 shows a perspective view showing the shape of an assorter of FIG. 2;

DETAILED DESCRIPTION OF THE PREFERRED EMBODIMENT

Figure 4:
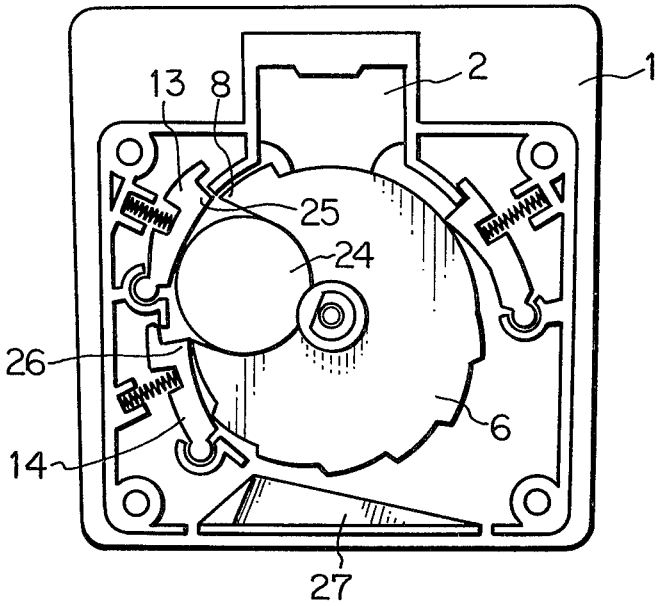
FIG. 4 shows an operating condition of the device of FIG. 2.
Figure 5:
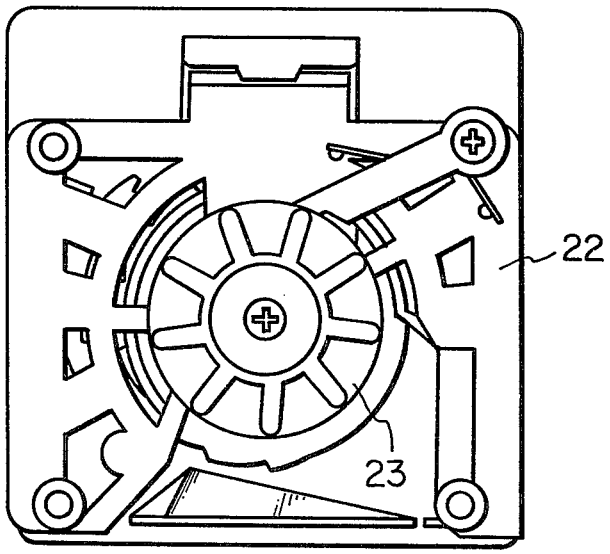
FIG. 5 shows a structural diagram of the device of FIG. 2 provided with a plastic cover.

The preferred embodiment of the present invention is explained below in connection with the accompanying figures of drawings. FIG. 2 shows a coin assorting mechanism in the case of using two coins, which may be provided on the back side of a plate 1 which can be removed from a vending machine as shown in FIG. 1. Provided at the upper portion of the plate 1 is a coin slot 2 and provided in the near center thereof is an aperture through which a rotating shaft 4 of a handle 3 (FIG. 1) is passed. A ratchet 6 having a notch 5 shaped into a predetermined dimension of any given coin, is mounted on the rotating shaft 4. A step portion 7 for preventing the shaft 4 from reverse rotation is formed in the proximity of the notch 5 of the ratchet 6 and further, an engaging end 8 is slightly projected therefrom. A frame 10 which has tapped apertures 9 at its four corners, respectively, is in the order of several millimeters in height and is provided on the plate 1. The frame 10 has recess walls 12 for supporting springs 11, respectively, and a shroud wall 15 for receiving and supporting the head of an assorter 13. The head of an assorter 14 is supported by a shroud wall 16 on the plate 1. FIG. 3 shows the shape of each assorter 13 and 14. Each of the assorters 13 and 14 includes a circle-shaped head and a slightly curved body, and as shown in FIG. 3, a curved recess 17 of the assorter 13 being provided on the upper portion of a coin contacting surface of the body and a curved recess 18 of the assorter 14 being provided on the lower portion and vice versa. The assorters 13 and 14 are rotatably supported respectively, in a respectively semicircular shaped wall 15 and 16 by their respective heads being placed in a respective one to the walls 15 and 16. The assorters 13 and 14 are biassed respectively by a respective spring 11 and are continually contacted by the ratchet 6. On the opposite side of the assorters 13 and 14, a stopper 19 for preventing the ratchet 6 from reverse rotation is provided. The stopper 19, having the same shape as the assorters 13 and 14, is rotatably adapted in a semi-circular-shaped wall 20 on the frame 10 by its circular-shaped head, and is depressed by a spring 21, whereby the stopper is continuously contacted by the ratchet 6. The step portion 7 of the ratchet 6, as described above is, therefore, caught by the stopper 19 to prevent the ratchet 6 from reverse rotation. FIG. 5 shows the coin assorting device of the present invention, to which is fixed a plastic cover 22. A plastic gear 23 mounted on the rotating shaft 4 rotates with the rotation thereof in order to operate a goods-supplying mechanism. Incidentally, in the drawing figures, reference numerals 24, 25, 26 and 27 represent respectively a coin, an edge of the assorter 13, an edge of the assorter 14 and an inclined surface for directing the coins.

Explaining now the operation of the present invention, when two suitable coins are thrown into the slot 2, these coins drop successively into the notch 5 and then are received therein in an overlapped condition. By rotating the handle 3 to the left (right, as observed from outside), each of the coins initially comes into contact with the edge 25 of the assorter 13 and then gradually pushes up the assorter 13 against the spring 11. By further rotating the handle, the coin of the lower side (front side, actually) comes into contact with the lower portion of the assorter 13, which has no recess, and continues to push the assorter 13 and therefore, the engaging end 8 of the ratchet 6 continues to push up the assorter 13 and passes therethrough without being locked by the edge 25 of the assorter 13 (refer to FIG. 2). If the coin of the lower side is unsuitable and cannot fully push up the assorter 13, the engaging end 8 is locked by the edge 25, thereby preventing the handle 3 from further rotation. In this case, the coin of the upper side enters the recess 17 of the stage portion and becomes free of the assorter 13 and has no influence thereon. Subsequently, after further rotation, the coin 24 comes into contact with the edge 26 of the assorter 14 and gradually pushes up the assorter 14 in the same manner. Then, the coin of the lower side enters the recess 18 and continues to push up the assorter 14 and therefore, the engaging end 8 passes through the assorter 14 without being locked by the edge 26.

If the coin of the upper side is unsuitable and cannot fully push up the assorter 14, the engaging end is locked, thereby preventing same from further rotation in that direction. When only one coin is thrown in, it can be checked by either of the assorters 13 and 14 in order to prevent rotation. When the engaging end is locked, it can be put back to an initial position by reverse rotation of the handle 3, thereby being capable of sorting out the unsuitable coin. On the other hand, when a suitable coin is thrown in, the ratchet 6 continues to rotate and at the half-rotated position, the coin can be delivered to the inclined surface 27 and then dropped into a coin box through the notch 5. In the case of assorting three or more coins, the operation may be accomplished in the manner as described above.

According to the present invention, as described above, it is possible to reliably sort out any coin or coins by an extremely simple construction.

We claim:

1. A coin assorting device for a vending machine in which a plurality of coins fed in a loose stack are required to operate the machine, the device comprising a plurality of coin assorting members equal in number to said plurality of coins, each of said members having a recess for clearing at least one coin and a respective coin contacting surface to be operated by a coin of a predetermined diameter in a predetermined position in said loose stack, a single rotatable ratchet formed with a single coin slot of a thickness sufficient to accept said stack of coins, said ratchet coin slot being defined by a trailing edge projecting radially outwardly towards said assorting members; each of said assorting members being pivotally mounted for motion towards and away from the axis of said rotatable ratchet; each of said assorting members comprising an edge adapted to contact said projecting edge of said rachet, said edge being positioned on said members to the front of said recess therein with respect to the direction of rotation of said ratchet with respect to said assorting members; a manual handle coupled to said ratchet via a rotatable shaft to directly drive said ratchet and to cause proper coins in said stack in said recess in said ratchet to operate said assorting members; stopper means for preventing said ratchet from reverse rotation, said stopper means comprising a step portion formed in said ratchet and a stopper member adapted to cooperate with said step portion to stop backward rotation of said ratchet when said stopper member is engaged with said step portion, a spring continually urging contact of said stopper member with said ratchet, a plurality of springs corresponding in number to said plurality of coin assorting members, a respective spring of said plurality of springs continually urging contact of a respective one of said members with said ratchet; a frame supporting said plurality of members, said ratchet, said stopper member and said plurality of springs; whereby said projecting edge of said ratchet will engage said edge of one of said assorting members to thereby prevent further forward rotation of said ratchet if a said stack of coins does not include a coin of the predetermined size and in the predetermined position in said stack needed to operate said one member of said plurality of members; said ratchet, said stopper means step portion, said projecting edge of said ratchet, and said assorting and said stopper members all being located with respect to each other such that if an improper coin is in said stack said projecting edge will contact an assorting member edge before said stropper member contacts said ratchet step position, whereby said ratchet can be turned backwards to remove the improper coin from the recess; a plate formed with a coin slot and an aperture through which said rotating shaft passes; and said frame being carried on said plate.

2. A coin assorting device according to claim 1, wherein said plurality of coin assorting members consists of two members.

3. A coin assorting device according to claim 1 or 2, wherein each spring of said plurality of springs extends between said frame and a respective surface of a respective one of said members.

4. A coin assorting device according to claim 3, wherein an end of each said member is rotatably held within a respective shroud wall formed on said frame.

5. A coin assorting device according to claim 1 or 2, wherein an end of each said member is rotatably held within a respective shroud wall formed on said frame.

6. A coin assorting device according to claim 1 or 2, wherein said further spring extends between said frame and a surface of said stopper.

7. A coin assorting device according to claim 6, wherein an end of said stopper is rotatably held within a shroud surface formed on said frame.

8. A coin assorting device according to claim 1 or 2, wherein an end of said stopper is rotatably held within a shroud surface formed on said frame.

* * * * *